US011365528B2

(12) United States Patent
Ennis

(10) Patent No.: US 11,365,528 B2
(45) Date of Patent: Jun. 21, 2022

(54) POSITION-BASED CROSS SLOPE CONTROL OF CONSTRUCTION MACHINE

(71) Applicant: Caterpillar Trimble Control Technologies LLC, Dayton, OH (US)

(72) Inventor: Nathan Ennis, Peoria, IL (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 196 days.

(21) Appl. No.: 16/719,724

(22) Filed: Dec. 18, 2019

(65) Prior Publication Data

US 2021/0189695 A1 Jun. 24, 2021

(51) Int. Cl.
*E02F 9/26* (2006.01)
*E02F 3/84* (2006.01)

(52) U.S. Cl.
CPC ..... *E02F 9/262* (2013.01); *E02F 3/841* (2013.01)

(58) Field of Classification Search
CPC ..... E02F 9/262; E02F 3/841; E02F 3/7636
See application file for complete search history.

(56) References Cited

U.S. PATENT DOCUMENTS 5,764,511 A * 6/1998 Henderson ..... G05D 1/0278 701/50
5,951,613 A * 9/1999 Sahm ..... G01S 19/53 701/50
9,290,910 B2 * 3/2016 Sharma ..... E02F 9/2025
9,637,889 B2 * 5/2017 Elkins ..... E02F 3/7645
9,783,955 B1 * 10/2017 Clar ..... G05D 1/0219
9,809,956 B1 * 11/2017 Sherlock ..... E02F 3/841
10,428,472 B1 * 10/2019 Worsley ..... E01C 23/07
2002/0162668 A1 * 11/2002 Carlson ..... E02F 3/847 172/4.5
2005/0027420 A1 * 2/2005 Fujishima ..... E02F 9/2045 701/50
2012/0239258 A1 * 9/2012 Konno ..... E01C 19/004 701/50
2014/0041883 A1 * 2/2014 Wahlmark ..... E02F 9/2012 172/795
2016/0237642 A1 * 8/2016 Gentle ..... E02F 9/2041
2017/0101762 A1 * 4/2017 Chaston ..... E02F 3/7636
2017/0114522 A1 * 4/2017 Maifield ..... E02F 3/765
2017/0114523 A1 * 4/2017 Horstman ..... E02F 9/2087
2019/0024340 A1 * 1/2019 Ono ..... E02F 3/76

* cited by examiner

*Primary Examiner* — Mussa A Shaawat
(74) *Attorney, Agent, or Firm* — Kilpatrick Townsend & Stockton

(57) ABSTRACT

Techniques for position-based cross slope control of a construction machine are disclosed. A site design that includes a set of target cross slopes for a construction site is obtained, with each of the set of target cross slopes associated with a 2D location within the construction site. Sensor data is captured using at least one sensor mounted to the construction machine. A geospatial position and a direction of travel of the construction machine are determined based on the sensor data. A target cross slope for the construction machine is generated by querying the site design using the geospatial position and the direction of travel.

20 Claims, 14 Drawing Sheets

POSITION-BASED CROSS SLOPE CONTROL OF CONSTRUCTION MACHINE

BACKGROUND

Modern construction machines have dramatically increased the efficiency of performing various construction projects. For example, earthmoving machines employing automatic slope control systems are able to grade project areas using fewer passes than what was previously done manually. As another example, modern asphalt pavers and other road makers have allowed replacement of old roads and construction of new roads to occur on the order of hours and days instead of what once took place over weeks and months. Construction crews also now comprise fewer individuals due to the automation of various aspects of the construction process. Much of the technological advances of construction machines are owed in part to the availability of accurate sensors that allow real-time monitoring of the condition and position of a machine's components and/or the environment surrounding the machine. Despite the improvements in modern construction machines, new systems, methods, and techniques are still needed.

SUMMARY

In a first aspect of the present invention, a computer-implemented method is provided. The method may include obtaining a site design that includes a set of target cross slopes for a construction site. In some embodiments, each of the set of target cross slopes is associated with a two-dimensional (2D) location within the construction site. The method may also include capturing sensor data using at least one sensor mounted to a construction machine. In some embodiments, the at least one sensor includes a position sensor. The method may further include determining a geospatial position of the construction machine based on the sensor data captured by the one or more sensors. The method may further include determining a direction of travel of the construction machine based on the sensor data captured by the one or more sensors. The method may further include generating a target cross slope for the construction machine by querying the site design using the geospatial position of the construction machine and the direction of travel of the construction machine.

In some embodiments, the geospatial position of the construction machine corresponds to a position of the position sensor. In some embodiments, the geospatial position of the construction machine corresponds to a position of a blade of the construction machine. In some embodiments, the method further includes determining a plurality of sensor points of the construction machine based on the sensor data captured by the one or more sensors. In some embodiments, the plurality of sensor points correspond to positions of the position sensor over a duration of time. In some embodiments, the method further includes projecting a center line of the construction machine based on the plurality of sensor points. In some embodiments, the method further includes determining a blade point of the construction machine based on the center line. In some embodiments, the blade point corresponds to the position of the blade. In some embodiments, capturing the sensor data using the at least one sensor mounted to the construction machine includes receiving, using a global navigation satellite systems (GNSS) receiver mounted to the construction machine, at least one wireless signal from at least one GNSS satellite. In some embodiments, the geospatial position of the construction machine is determined based on the at least one wireless signal. In some embodiments, the direction of travel of the construction machine is determined based on the at least one wireless signal.

In a second aspect of the present invention, a non-transitory computer-readable medium is provided. In some embodiments, the non-transitory computer-readable medium stores instructions therein that, when executed by one or more processors, cause the one or more processors to perform the operations of the method of the first aspect of the present invention.

In a third aspect of the present invention, a machine control system is provided. The machine control system may include a position sensor that is mounted to a construction machine and is configured to detect a geospatial position of the construction machine. The machine control system may also include a control unit communicatively coupled to the position sensor and configured to perform the operations of the method of the first aspect of the present invention.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced.

In the appended figures, similar components and/or features may have the same numerical reference label. Further, various components of the same type may be distinguished by following the reference label with a letter or by following the reference label with a dash followed by a second numerical reference label that distinguishes among the similar components and/or features. If only the first numerical reference label is used in the specification, the description is applicable to any one of the similar components and/or features having the same first numerical reference label irrespective of the suffix.

DETAILED DESCRIPTION

Embodiments of the present disclosure relate to systems, methods, and other techniques for generating position-dependent target cross slopes for controlling a construction machine. In some instances, embodiments described herein allow an operator to map and define cross slopes for rural roads or haul roads for road maintenance purposes. After defining cross slopes for all roads to be maintained, these roads and their associated cross slopes can be saved in a design file, which can be loaded onto a control unit that controls the construction machine to the appropriate cross slopes during road maintenance activities. In some embodiments, the control unit can query the design file using the construction machine's position and direction of travel, which can be derived using sensor data captured by various sensors mounted to the machine.

Figure 1:
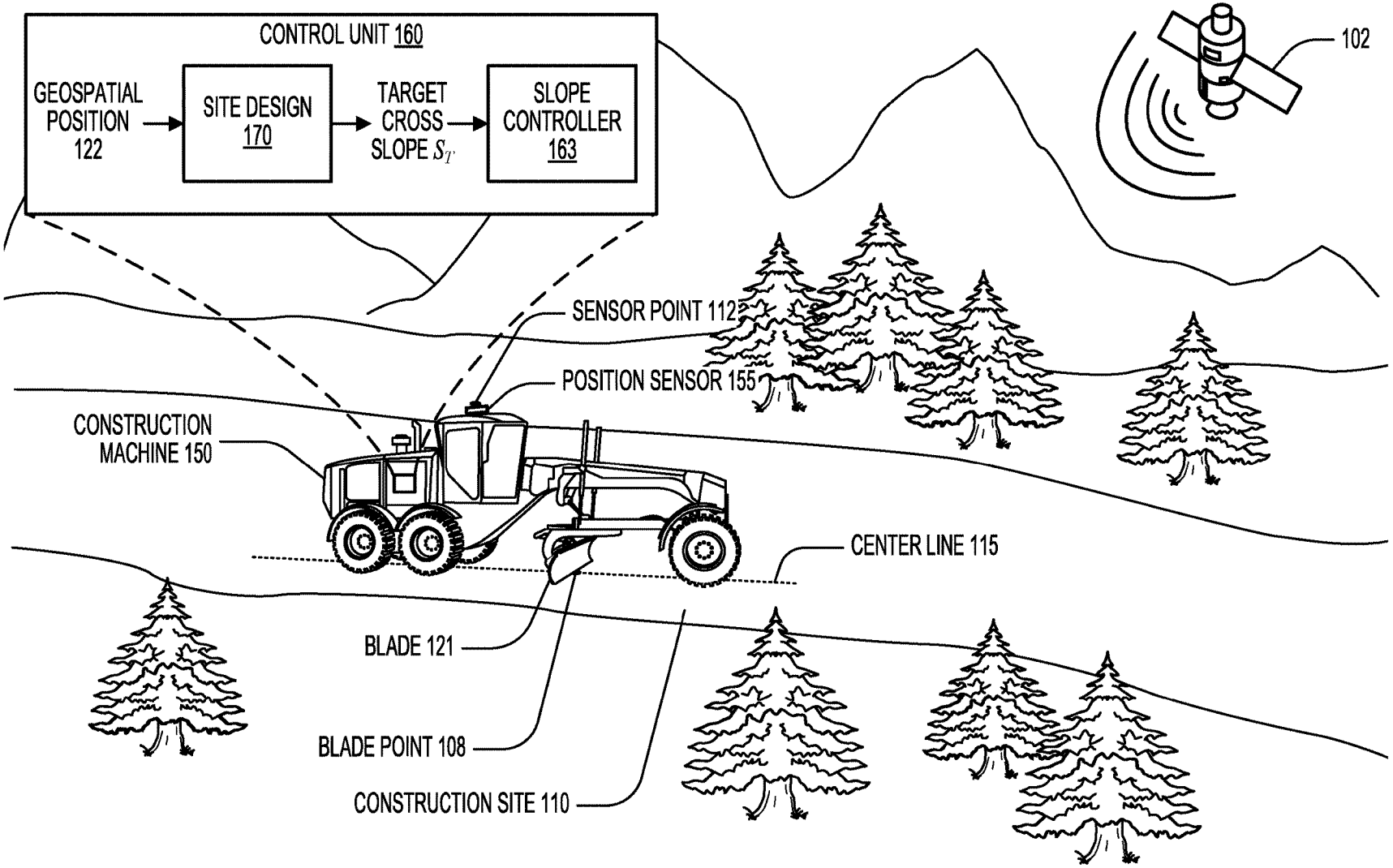
FIG. 1 illustrates an example implementation of one or more techniques of the present disclosure within a construction environment.

FIG. 1 illustrates an example implementation of one or more techniques of the present disclosure within a construction environment. Specifically, FIG. 1 shows a construction machine 150 being deployed at a construction site 110 and having the control thereof at least partially implemented by a control unit 160 which, in various embodiments, may be communicatively coupled to a position sensor 155 mounted to construction machine 150 through a wired and/or wireless connection. While construction site 110 is generally described herein as corresponding to an earthmoving site such as a road or building site, the present disclosure is applicable to a wide variety of construction projects. Similarly, while construction machine 150 is generally described herein as corresponding to an earthmoving construction machine, the various techniques described herein are applicable to a wide variety of construction machines such as graders, excavators, bulldozers, backhoes, pavers (e.g., concrete, asphalt, slipform, vibratory, etc.), compactors, scrapers, loaders, and the like.

In some embodiments, construction machine 150 may include a tractor with wheels, axles, and a gasoline-, diesel-, electric-, or steam-powered engine for providing power and traction to construction machine 150 to drive along a desired path, often at a constant speed. An operator of construction machine 150 may provide inputs to control unit 160 using various input devices such as levers, switches, buttons, pedals, steering wheels, and touch screens, which can cause various actuators to move construction machine 150. In some instances, construction machine 150 may include a blade 121 that can interact with earth at construction site 110 by grading the earth in accordance with a desired cross slope, alternatively referred to as a target cross slope $S_T$.

In some embodiments, control unit 160 may determine a geospatial position 122 of construction machine 150 based on sensor data captured by one or more sensors (e.g., position sensor 155) mounted to construction machine 150. For example, position sensor 155 may be a global navigation satellite systems (GNSS) receiver that receives wireless signals from one or more GNSS satellites 102. By processing the received wireless signals, a position of the GNSS receiver may be calculated, which is alternatively referred to herein as a sensor point 112. Geospatial position 122 may correspond to sensor point 112 or, in some embodiments, additional processing of sensor point 112 (as well as multiple time sequenced sensor points 112 captured over a duration of time) may produce a center line 115 that corresponds to the past and/or predicted trajectory of construction machine 150. Upon calculation of center line 115, a blade point 108 can be calculated at the intersection point between center line 115 and blade 121. Blade point 108 can provide a more accurate estimation of the actual operating position of construction machine 105 for use by control unit 160, and accordingly can be used as geospatial position 122 when sufficient sensor data is available.

During operation of construction machine 150, and in accordance with some embodiments of the present disclosure, geospatial position 122 is determined and is used to query a site design 170, which may provide translations between two-dimensional (2D) positions within construction site 110 (combined with a concurrently determined direction of travel of construction machine 150) and target cross slopes $S_T$. The obtained target cross slope is fed into a slope controller 163, which may employ various control mechanisms (such as, for example, a proportional-integral-derivative (PID) controller) for driving an actual cross slope toward the target cross slope. The actual cross slope of construction machine 150 may be adjusted by sending a control signal to one or more actuators that are mechanically coupled to the blade.

Figure 2:
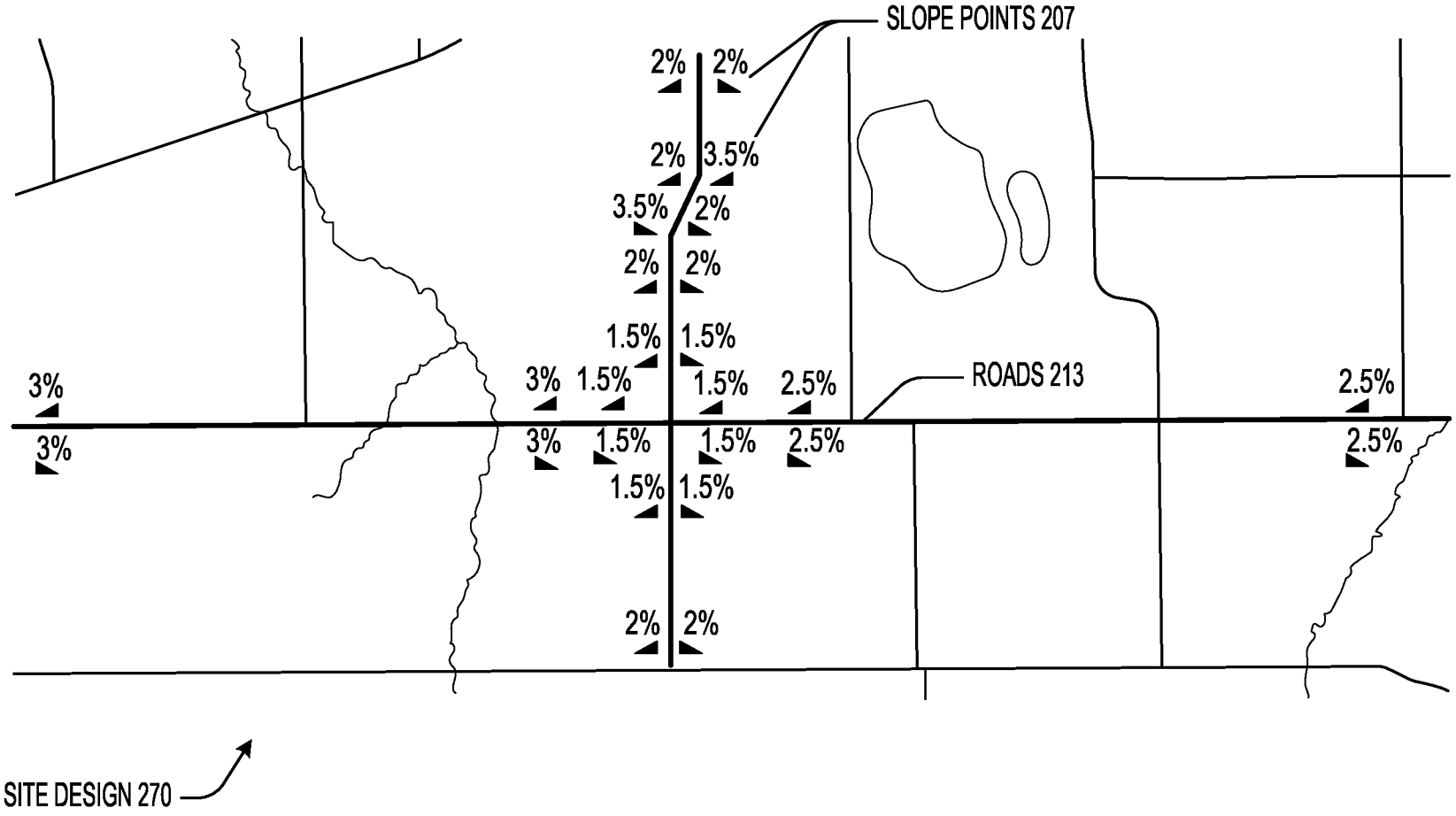
FIG. 2 illustrates an example site design in accordance with various embodiments of the present disclosure.

FIG. 2 illustrates an example site design 270 in accordance with various embodiments of the present disclosure. Site design 270 may be received by control unit 160 from a user input device or from an external computing system. In some embodiments, site design 270 includes multiple slope points 207 overlaid onto a 2D map containing roads 213. Each of slope points 207 may be associated with a 2D location and may include a target cross slope. The target cross slope may be expressed as a percentage and may further indicate whether the slope increases or decreases with respect to the center of a road. In some instances, slopes that decrease from the center of the road toward the outside of the road may be positive values and slopes that increase from the center of the road toward the outside of the road may be negative values.

Figure 3A:
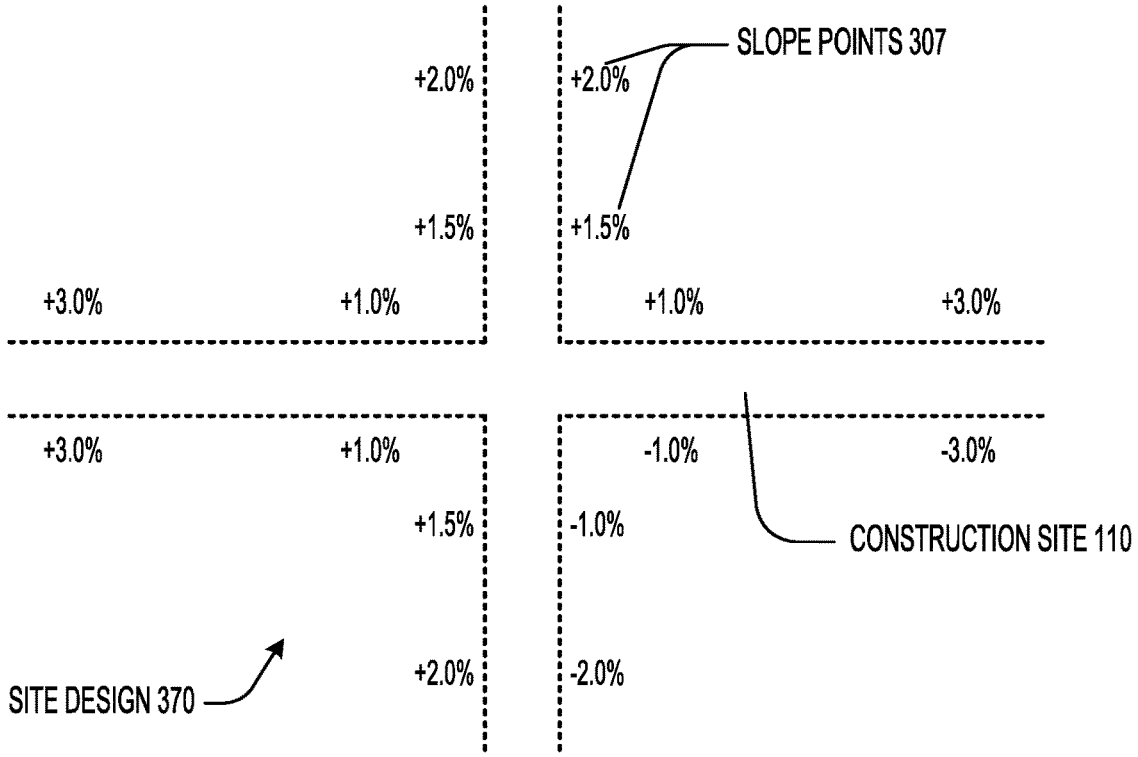
FIGS. 3A-3F illustrate example steps for processing a site design in accordance with various embodiments of the present disclosure.

FIGS. 3A-3F illustrate example steps for processing a site design 370 in accordance with various embodiments of the present disclosure. In FIG. 3A, a site design 370 for a construction site 110 with two intersecting roads is received by control unit 160 from a user input device or from an external computing system. Site design 370 includes slope points 307 that are each associated with a 2D location and include a target cross slope, with positive values corresponding to slopes that decrease from the center of the road toward the outside of the road and negative values corresponding to slopes that increase from the center of the road toward the outside of the road.

Figure 3B:
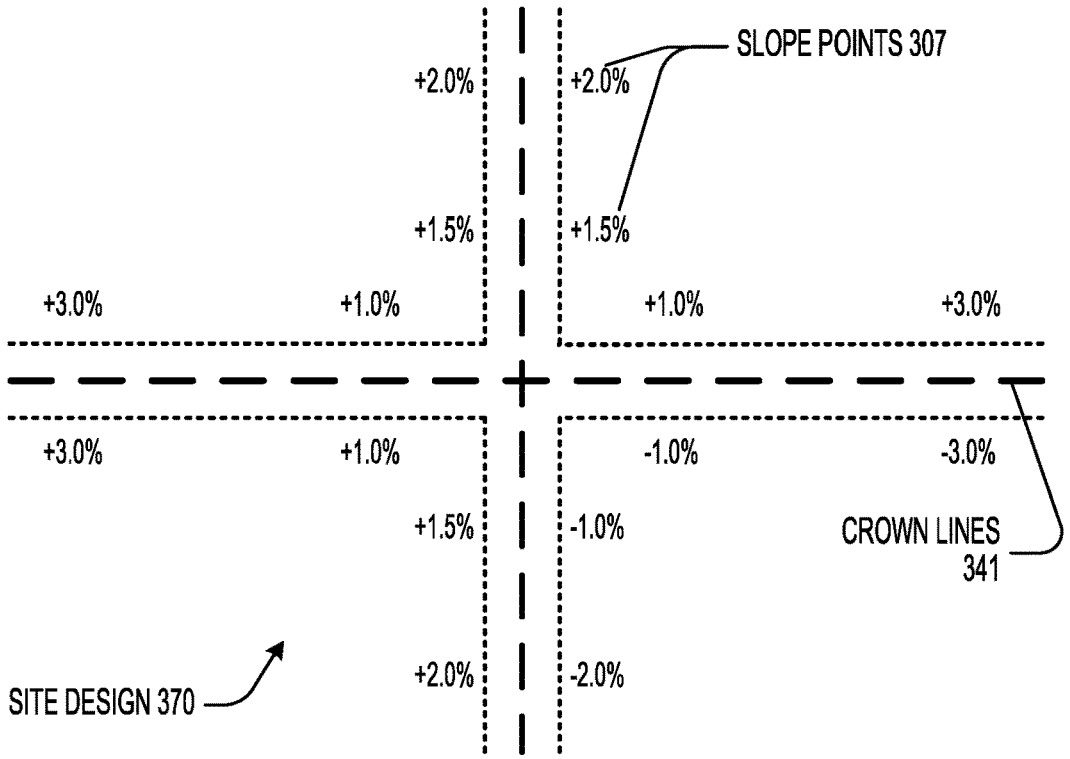
Figure 3C:
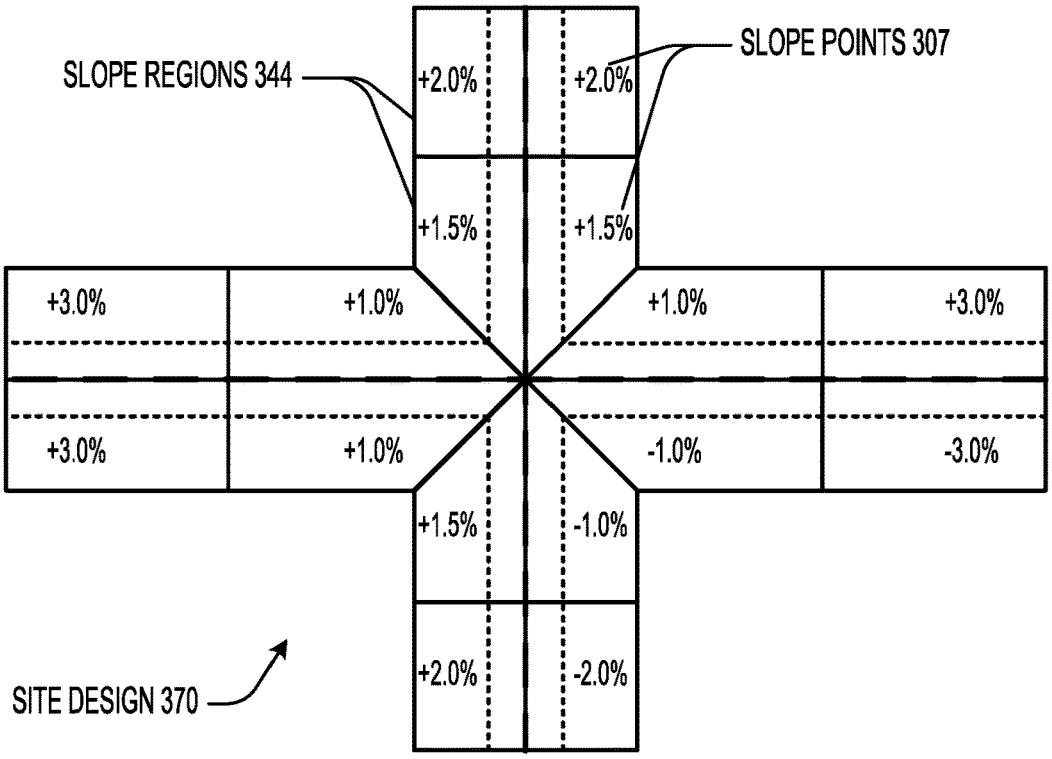

In FIG. 3B, site design 370 is modified (e.g., by control system 160) by generating crown lines 341 along the centers of the intersecting roads. In some embodiments, crown lines 341 may be generated at certain distances from the edges of the roads based on the particular road design. For example, the road may have uneven numbers of lanes for opposite directions. In FIG. 3C, slope regions 344 are generated based on slope points 307 and crown lines 341. Each of slope regions 344 may be associated with a 2D region that includes the 2D location associated with the corresponding slope point 307. Slope regions 344 may be formed by drawing bisecting lines that are equidistant from neighboring slope points 307 at all points along the lines. Additional lines are drawn on crown lines 341 as well as at some maximum distance from construction site 110, e.g., 20 meters. Accordingly, the target cross slopes shown in FIG.

3C may be associated with the location of the corresponding slope point 344 and the corresponding slope region 307 that encompasses the slope point.

Figure 3D:
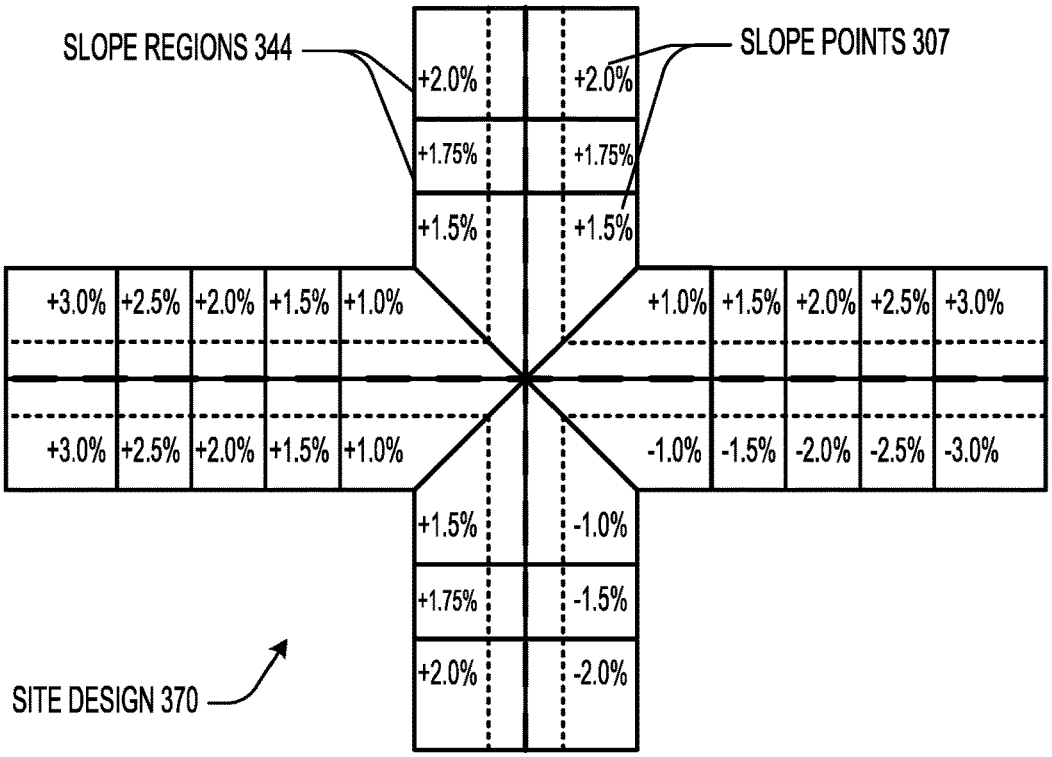
Figure 3E:
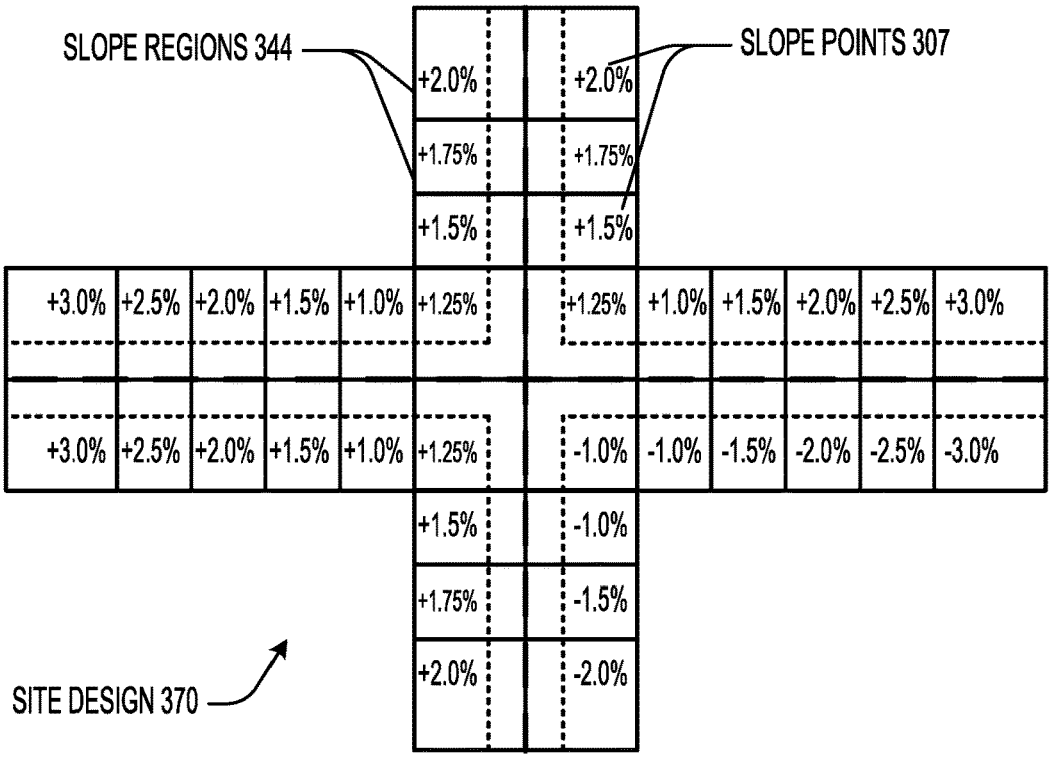

In FIG. 3D, site design 370 is modified (e.g., by control system 160) by generating additional slope points 307 between the original slope points and thereafter generating additional slope regions 344 using the old and new slope points, in the manner described in reference to FIG. 3C. Slope values for new slope points can be calculated as the average of the slope values for the old slope points from which the new slope points were generated. In FIG. 3E, site design 370 is modified (e.g., by control system 160) by generating additional slope points 307 similar to that described in FIG. 3D except that additional slope points 307 are generated at each corner of the intersection, providing less congested boundaries between adjacent slope regions 344.

Figure 3F:
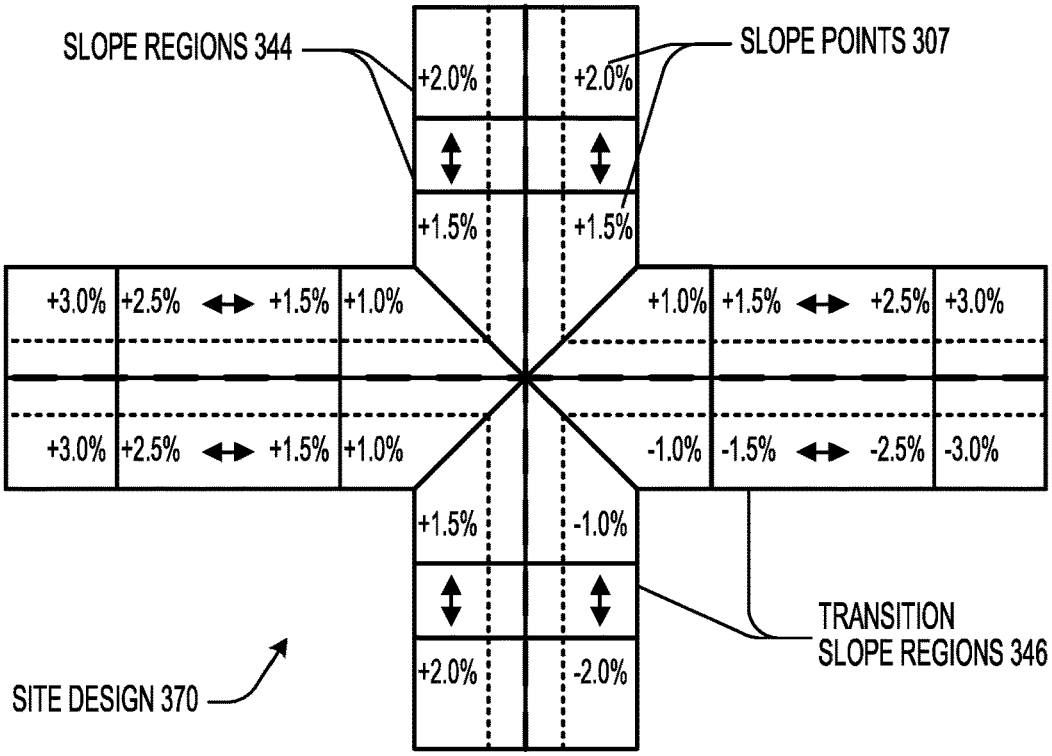

In FIG. 3F, site design 370 is modified (e.g., by control system 160) by generating additional slope points 307 between the original slope points and thereafter generating additional slope regions 344 using the old and new slope points, with (a portion of) the slope regions generated using new slope points comprising transition slope regions 346. Within each of transition slope regions 346, the associated target cross slope can vary linearly between the slope values of neighboring slope points.

Figure 4:
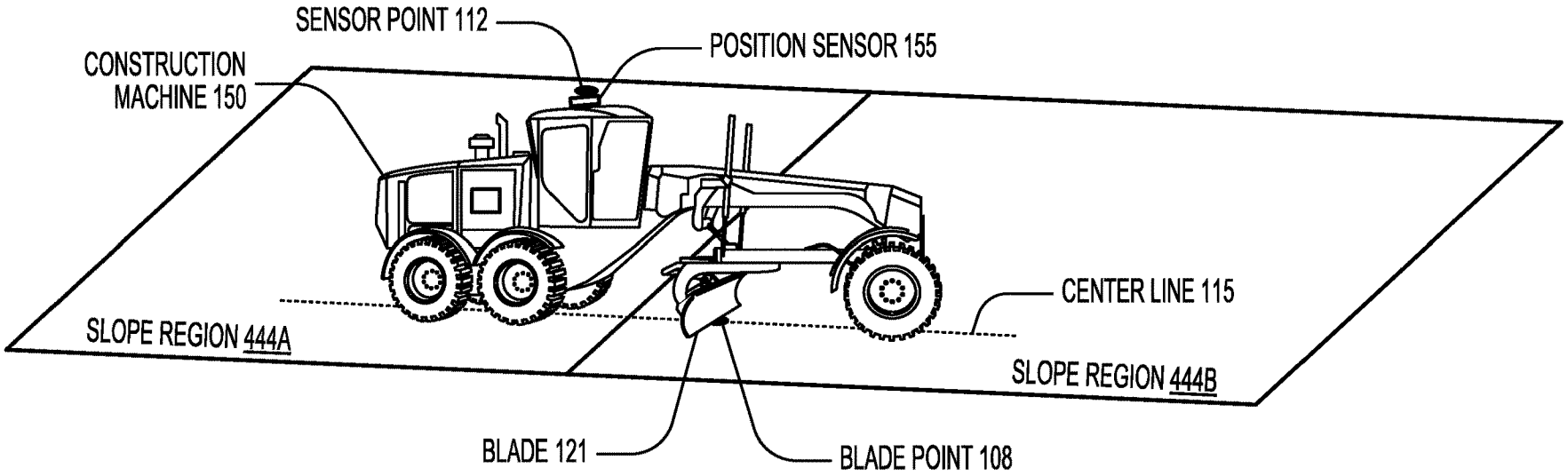
FIG. 4 illustrates various example steps for matching a geospatial position of a construction machine to a slope region as defined in a site design.

FIG. 4 illustrates various example steps for matching a geospatial position of construction machine 150 to a slope region as defined in a site design. In some embodiments, position sensor 155 may be used to compute sensor point 112. If sensor point 112 is used as geospatial position 122 of construction machine 150, then the geospatial position may be determined to be located within slope region 444A, and the target cross slope associated with slope region 444A may be fed into slope controller 163. In some embodiments, sensor points 112 may not be used as geospatial position 122, but rather multiple sensor points 112 may be used to determine blade point 108 using the intersection point between center line 115 and blade 121. If blade point 108 is used as geospatial position 122 of construction machine 150, then the geospatial position may be determined to be located within slope region 444B, and the target cross slope associated with slope region 444B may be fed into slope controller 163.

Figure 5:
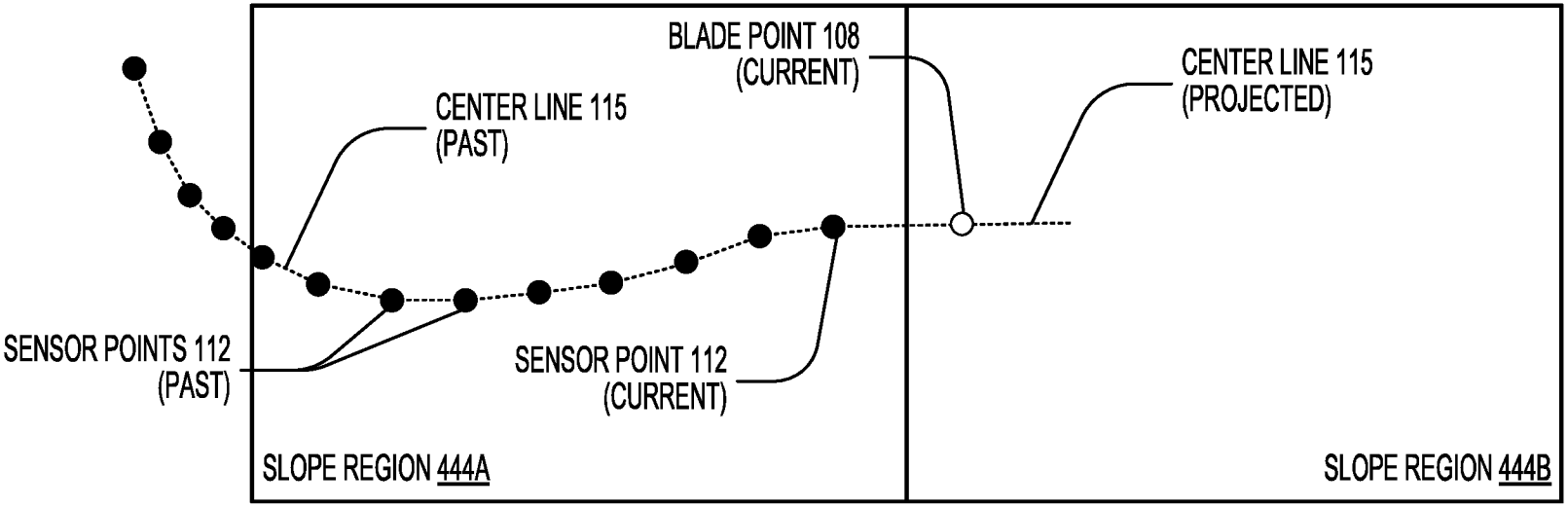
FIG. 5 illustrates various example steps for matching a geospatial position of a construction machine to a slope region as defined in a site design.

FIG. 5 illustrates various example steps for matching a geospatial position of construction machine 150 to a slope region as defined in a site design. In some embodiments, position sensor 155 may be used to compute multiple sensor points 112 over a duration of time. Sensor points 112 may be used to determine a direction of travel of construction machine 150 as well as geospatial position 122 of construction machine 150. To determine the direction of travel, the 2D displacement between successive sensor points 112 may be determined. In the illustrated example, construction machine 150 may be determined to be moving to the right as sensor points 112 are moving from left to right. To determine blade point 108, sensor points 112 are used to project center line 115. In some instances, center line 115 is determined by extrapolating center line 115 beyond the last-determined sensor point 112, using past sensor points 112 to determine the past center line. In the illustrated example, the current sensor point 112 is located within slope region 444A and the current blade point 108 is located within slope region 444B.

Figure 6:
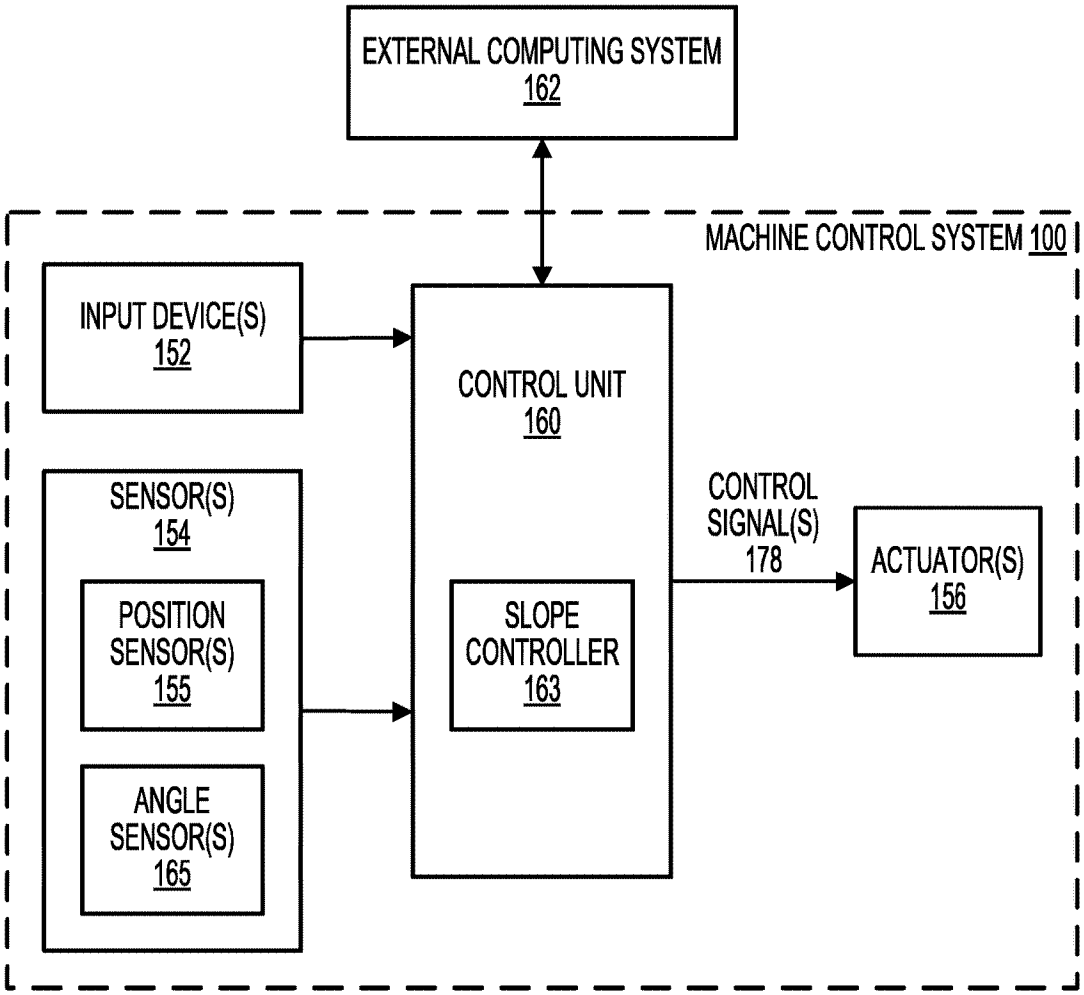
FIG. 6 illustrates an example machine control system.

FIG. 6 illustrates an example machine control system 100, in accordance with some embodiments of the present disclosure. Machine control system 100 may include various input devices 152, sensors 154, actuators 156, and computing devices for allowing one or more operators of construction machine 150 to complete a high-precision grading operation. The components of machine control system 100 may be mounted to or integrated with the components of construction machine 150 such that construction machine 150 may include machine control system 100. The components of machine control system 100 may be communicatively coupled to each other via one or more wired and/or wireless connections.

Machine control system 100 may include a control unit 160 that receives data from the various sensors and inputs and generates commands that are sent to the various actuators and output devices. Control unit 160 may include one or more processors and an associated memory. In some embodiments, control unit 160 may be communicatively coupled to an external computing system 162 located external to machine control system 100 and construction machine 150. External computing system 162 may send instructions to control unit 160 of the details of a grading operation. External computing system 162 may also send alerts and other general information to control unit 160, such as traffic conditions, weather conditions, the locations and status of material transfer vehicles, and the like.

In some embodiments, machine control system 100 includes one or more input device(s) 152 for receiving the target cross slope $S_T$ from a user and sending the target cross slope $S_T$ to control unit 160. Input device(s) 152 may include a keyboard, a touchscreen, a touchpad, a switch, a lever, a button, a steering wheel, an acceleration pedal, a brake pedal, and the like. In some embodiments, input device(s) 152 may be mounted to any physical part of asphalt paver 100. Input device(s) 152 may further receive user inputs indicating a desired movement of construction machine 150, a desired movement of blade 121, and the like.

In some embodiments, sensor(s) 154 may include one or more position sensor(s) 155 and/or angle sensor(s) 165. Position sensor(s) 155 may be a combination of GNSS receivers, which determine position using wireless signals received from satellites, and total stations, which determine position by combining distance, vertical angle, and horizontal angle measurements. Angle sensor(s) 165 may be any type of sensor that detects angular rate and/or angular position. In some embodiments, angle sensor(s) 165 may comprise one or more inertial measurement units (IMUs), which are devices capable of detecting acceleration, angular rate, and/or angular position. For example, an IMU may include one or more accelerometers, one or more gyroscopes, and/or one or more magnetometers, among other possibilities. In some embodiments, angle sensor(s) 165 may directly detect angular rate and may integrate to obtain angular position, or alternatively an angle sensor may directly measure angular position and may determine a change in angular position (e.g., determine the derivative) to obtain angular rate. In many instances, angle sensor(s) 165 can be used to determine the yaw angle (rotation angle with respect to a vertical axis), the pitch angle (rotation angle with respect to a transverse axis), and/or the roll angle (rotation angle with respect to a longitudinal axis) of construction machine 150.

In some embodiments, control unit 160 includes a slope controller 163 that calculates the measured cross slope $S_M$ using the sensor data, performs a comparison between a measured cross slope $S_M$ and the target cross slope $S_T$, and causes movement of construction machine 150 based on the comparison by outputting one or more control signal(s) 178 to one or more actuator(s) 156. Control signal(s) 178 may include direct current (DC) or alternating current (AC) voltage signals, DC or AC current signals, and/or information-containing signals. Slope controller 163 may be a stand-alone hardware component or may be integrated with other hardware components within control unit 160. The functionality of slope controller 163 is described in further detail in reference to FIG. 7.

Figure 7:
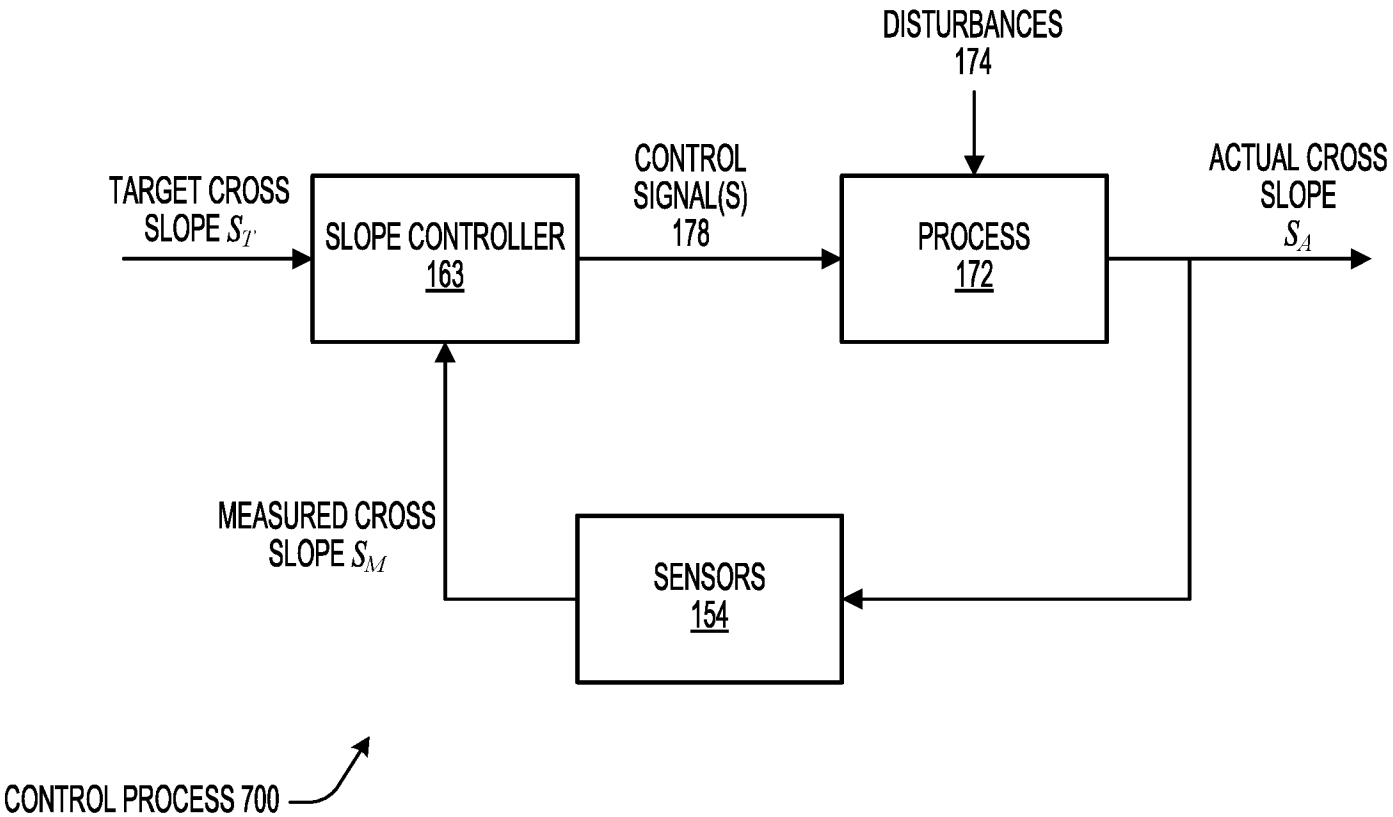
FIG. 7 illustrates an example control process.

FIG. 7 illustrates an example control process 700, according to some embodiments of the present disclosure. During a particular iteration of control process 700, or prior to a series of iterations of control process 700, slope controller 163 may receive the target cross slope $S_T$ of construction machine 150. During each iteration, the measured cross slope $S_M$ of construction machine 150 may be determined based on sensor data captured by sensors 154. In some embodiments, slope controller 163 calculates an error between the measured cross slope $S_M$ and the target cross slope $S_T$ by, for example, subtracting the two values. In some embodiments, slope controller 163 comprises a PID controller that generates control signal(s) 178 based on a first value equal to a first constant multiplied by the current error, a second value equal to a second constant multiplied by past values of the error, and/or a third value equal to a third constant multiplied by estimated future values of the error. For example, during a particular iteration of control process 700, control signal(s) 178 may be generated by modifying control signal(s) 178 generated during the previous iteration based on the magnitude of the error such that larger errors cause larger modifications to control signal(s) 178.

Slope controller 163 may be configured to influence process 172 so as to minimize the calculated error between the measured cross slope $S_M$ and the target cross slope $S_T$. Because process 172 is influenced by disturbances 174 (e.g., variations in the consistency of the terrain, irregularities in the terrain, changes in the velocity of construction machine 150, etc.) and also because the measured cross slope $S_M$ has a time-delayed and/or indirect relationship with the actual cross slope $S_A$, convergence between the measured cross slope $S_M$, the target cross slope $S_T$, and the actual cross slope $S_A$ may involve several iterations through control process 700.

Figure 8:
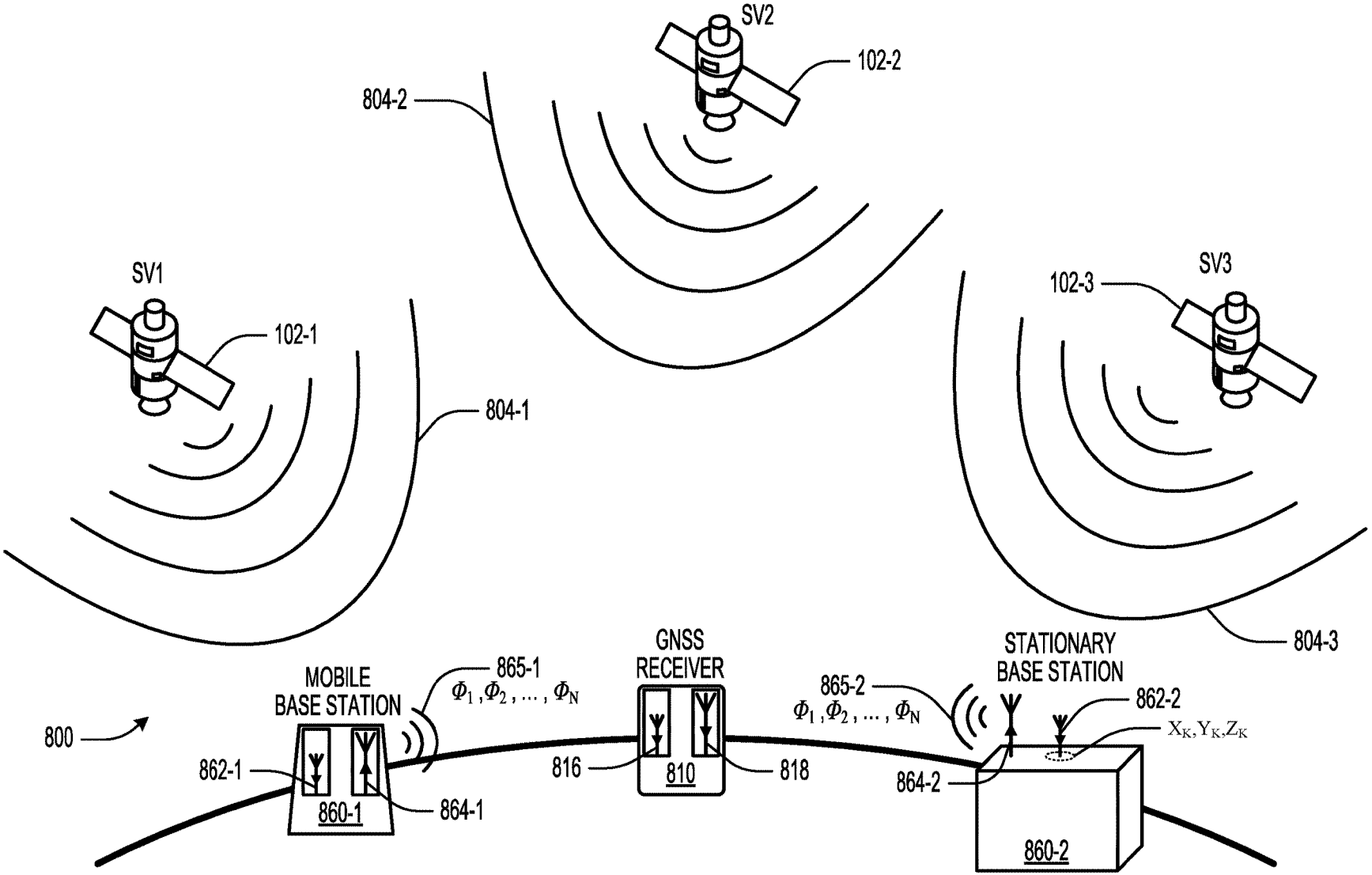
FIG. 8 illustrates an example GNSS receiver operating within a GNSS.

FIG. 8 illustrates an example of a GNSS receiver 810 operating within a GNSS 800, according to some embodiments of the present disclosure. Examples of currently operational GNSSs include the United States' Global Positioning System (GPS), the Russian Global Navigation Satellite System (GLONASS), the Chinese BeiDou Satellite Navigation System, the European Union's (EU) Galileo, and the Satellite-based Augmentation System (SBAS). In some instances, the performance of GNSS receiver 810 may be improved when used in conjunction with a mobile base station 860-1 and/or a stationary base station 860-2. In some embodiments, GNSS 800 includes one or more GNSS satellites 102, i.e., space vehicles (SV), in orbit above GNSS receiver 810 and base stations 860. GNSS satellites 102 may continuously, periodically, or intermittently broadcast wireless signals 804 containing pseudo-random-noise (PRN) codes modulated onto carrier frequencies (e.g., L1 and/or L2 carrier frequencies).

Wireless signals 804 corresponding to different GNSS satellites 102 may include different PRN codes that identify a particular GNSS satellite 102 such that receivers may associate different distance estimates (i.e., pseudoranges) to different GNSS satellites 802. For example, GNSS satellite 102-1 may broadcast wireless signals 804-1 which contain a different PRN code than the PRN code contained in wireless signals 804-2 broadcasted by GNSS satellite 102-2. Similarly, GNSS satellite 102-3 may broadcast wireless signals 804-3 which contain a different PRN code than the PRN codes contained in wireless signals 804-1 and 804-2 broadcasted by GNSS satellites 102-1 and 102-2, respectively. One or more of wireless signals 804 may be received by a GNSS antenna 816 of GNSS receiver 810. GNSS antenna 816 may be a patch antenna, a turnstile antenna, a helical antenna, a parabolic antenna, a phased-array antenna, a resistive plane antenna, a choke ring antenna, a radome antenna, among other possibilities.

Each of GNSS satellites 102 may belong to one or more of a variety of system types, such as GPS, GLONASS, Galileo, and BeiDou, and may transmit wireless signals having one or more of a variety of signal types (e.g., GPS L1 C/A, GPS L2C, Galileo E1, Galileo ESA, etc.). For example, GNSS satellite 102-1 may be a GPS satellite and may transmit wireless signals having a GPS L1 C/A signal type (i.e., wireless signals having frequencies within the GPS L1 band and having been modulated using C/A code). GNSS satellite 102-1 may additionally or alternatively transmit wireless signals having a GPS L2C signal type (i.e., wireless signals having frequencies within the GPS L2 band and having been modulated using L2 civil codes). In some embodiments, GNSS satellite 102-1 may additionally be a Galileo satellite and may transmit wireless signals having a Galileo signal type (e.g., Galileo E1). Accordingly, a single satellite may include the ability to transmit wireless signals of a variety of signal types.

GNSS receiver 810 may use the distance estimates between itself and GNSS satellites 102-1, 102-2, and 102-3 to generate a position estimate through a process called trilateration. In some instances, trilateration involves generating multiple spheres having center locations corresponding to the locations of GNSS satellites 102 and radii corresponding to the distance estimates (i.e., pseudoranges). The intersection points of the spheres are used as the position estimate for GNSS receiver 810. The position estimate may be continuously, periodically, or intermittently updated by generating new distance estimates and performing trilateration using the new distance estimates. Subsequent position estimates may benefit from previous position estimates through filtering processes (e.g., Kalman filtering) capable of improving position estimate accuracy. Position estimates may also be determined using other techniques. In practice, a fourth satellite may be observed to estimate the receiver clock error with respect to the satellite system time.

Mobile base station 860-1 and stationary base station 860-2 may include GNSS antennas 862-1 and 862-2, respectively, where GNSS antenna 862-2 is positioned at a known position (e.g., $X_K$, $Y_K$, $Z_K$). Mobile base station 860-1 may be movable such that multiple mobile base stations 860-1 may be brought within or surrounding the construction site so as to provide high-accuracy position estimates. Each of GNSS antennas 862 may be similar to GNSS antenna 816 and may be configured to receive one or more of wireless signals 804. For example, each of GNSS antennas 862 may be a patch antenna, a turnstile antenna, a helical antenna, a parabolic antenna, a phased-array antenna, a resistive plane antenna, a choke ring antenna, a radome antenna, among other possibilities.

Each of base stations 860 may send a correction signal 865 containing correction data to GNSS receiver 810. The correction data is used by GNSS receiver 810 to improve the accuracy of its position estimate. In some embodiments, the correction data includes a plurality of carrier phases $\Phi_1$, $\Phi_2$, . . . , $\Phi_N$, where N is the number of GNSS satellites. In some embodiments, the correction data includes a 3D offset amount (e.g., $X_C$, $Y_C$, $Z_C$) for modifying the position estimate of GNSS receiver 810. In one example, position estimates of stationary base station 860-2 made using GNSS antenna 862-2 are compared to the known position and the correction data may be generated based on the comparison. In some embodiments, the correction data includes any one of various types of raw or processed satellite data.

Correction signals 865 containing the correction data may be wirelessly transmitted by base stations 860 using correction antennas 864 and may be received by GNSS receiver 810 using a correction antenna 818. The correction signals 865 may be transmitted continuously, periodically, or intermittently by base stations 860. In some embodiments, correction signals 865 are transmitted over a set of wireless frequencies outside the GNSS frequencies (e.g., lower than the GNSS frequencies). In some embodiments, correction antennas 864 may be used for transmission only and correction antenna 818 may be used for reception only, although in some embodiments additional handshaking between GNSS receiver 810 and base stations 860 may occur.

Figure 9:
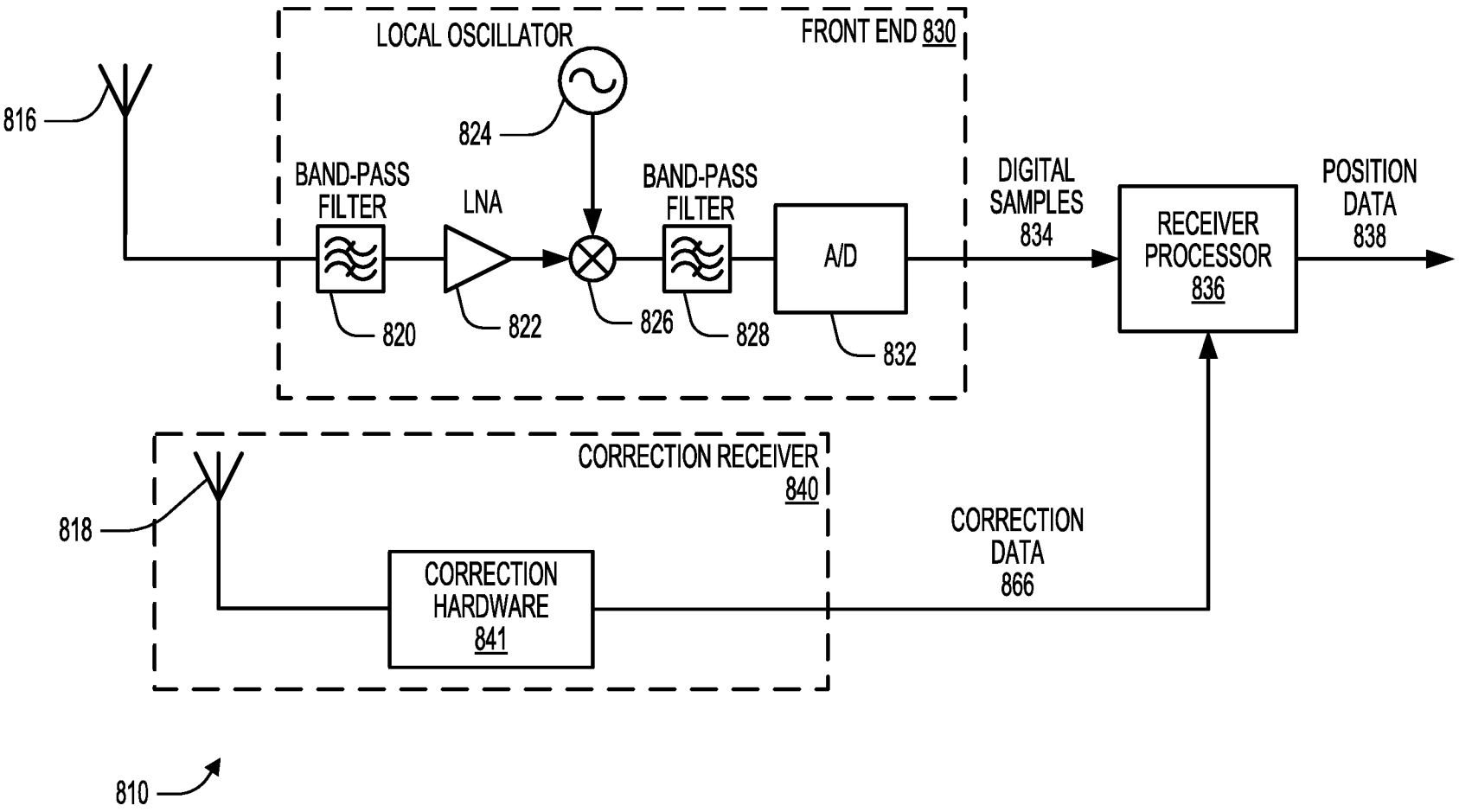
FIG. 9 illustrates an example block diagram of a GNSS receiver.

FIG. 9 illustrates an example block diagram of GNSS receiver 810, according to some embodiments of the present disclosure. GNSS receiver 810 includes antenna 816 for receiving wireless signals 804 and sending/routing wireless signals 804 to an RF front end 830. RF front ends are well known in the art, and in some instances include a band-pass filter 820 for initially filtering out undesirable frequency components outside the frequencies of interest, a low-noise amplifier (LNA) 822 for amplifying the received signal, a local oscillator 824 and a mixer 826 for down converting the received signal from RF to intermediate frequencies (IF), a band-pass filter 828 for removing frequency components outside IF, and an analog-to-digital (A/D) converter 832 for sampling the received signal to generate digital samples 834.

In some instances, RF front end 830 includes additional or fewer components than that shown in FIG. 9. For example, RF front end 830 may include a second local oscillator (90 degrees out of phase with respect to the first), a second mixer, a second band-pass filter, and a second A/D converter for generating digital samples corresponding to the quadrature component of wireless signals 804. Digital samples corresponding to the in-phase component of wireless signals 804 and digital samples corresponding to the quadrature component of wireless signals 804 may both be sent to a correlator. In some embodiments, digital samples corresponding to both in-phase and quadrature components may be included in digital samples 834.

Other components within RF front end 830 may include a phase-locked loop (PLL) for synchronizing the phase of local oscillator 824 with the phase of the received signal, and a phase shifter for generating a second mixing signal using local oscillator 824 that is 90 degrees out of phase with local oscillator 824. In some embodiments, RF front end 830 does not include band-pass filter 820 and LNA 822. In some embodiments, A/D converter 832 is coupled directly to antenna 816 and samples the RF signal directly without down-conversion to IF. In some embodiments, RF front end 830 only includes band-pass filter 820 and A/D converter 832. Other possible configurations of RF front end 830 are possible.

Digital samples 834 generated by RF front end 830 are sent to a correlator and/or a receiver processor 836. A correlator may perform one or more correlations on digital samples 834 using local codes. In some embodiments, one or more operations performed by the correlator may alternatively be performed by receiver processor 836. In some embodiments, the correlator is a specific piece of hardware, such as an application-specific integrated circuit (ASIC) or a field-programmable gate array (FPGA). In some embodiments, operations performed by the correlator are performed entirely in software using digital signal processing (DSP) techniques.

Based on multiple distance estimates corresponding to multiple GNSS satellites 802, as well as correction data 866 generated by a correction receiver 840 having correction hardware 841, receiver processor 836 generates and outputs GNSS position data 838 comprising a plurality of GNSS points. Each of the plurality of GNSS points may be a 3D coordinate represented by three numbers. In some embodiments, the three numbers may correspond to latitude, longitude, and elevation/altitude. In other embodiments, the three numbers may correspond to X, Y, and Z positions. Position data 838 may be outputted to be displayed to a user, transmitted to a separate device (e.g., computer, smartphone, server, etc.) via a wired or wireless connection, or further processed, among other possibilities.

Figure 10A:
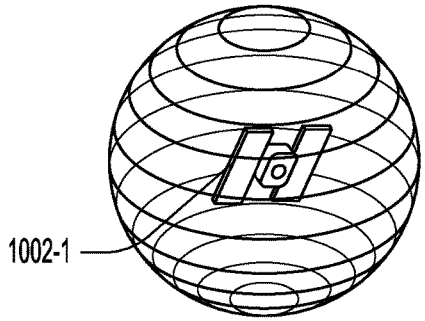
FIGS. 10A-10D illustrate a trilateration technique performed by a GNSS receiver to generate a position estimate.
Figure 10B:
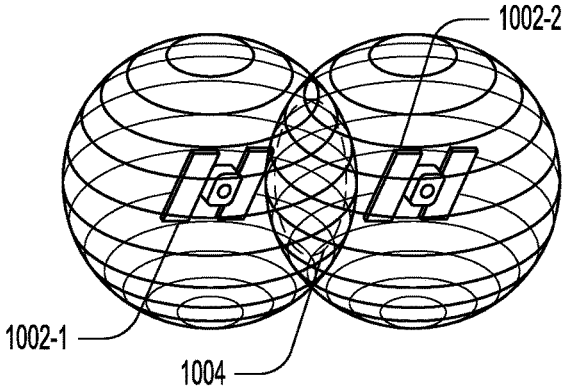

FIGS. 10A-10D illustrate a trilateration technique performed by GNSS receiver 810 (and similarly base stations 860) to generate a position estimate, according to some embodiments of the present disclosure. FIG. 10A shows a first scenario in which GNSS receiver 810 receives GNSS signals 804 from a first satellite 1002-1 and generates a distance estimate (e.g., 20,200 km) for that satellite. This informs GNSS receiver 810 that it is located somewhere on the surface of a sphere with a radius of 20,200 km, centered on first satellite 1002-1. FIG. 10B shows a second scenario in which GNSS receiver 810 receives GNSS signals 804 from a second satellite 1002-2 and generates a distance estimate (e.g., 23,000 km) for the additional satellite. This informs GNSS receiver 810 that it is also located somewhere on the surface of a sphere with a radius of 23,000 km, centered on second satellite 1002-2. This limits the possible locations to somewhere on the region 1004 where the first sphere and second sphere intersect.

Figure 10C:
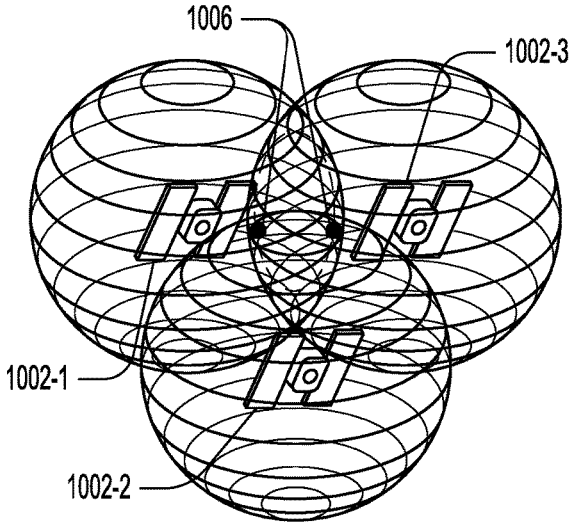
Figure 10D:
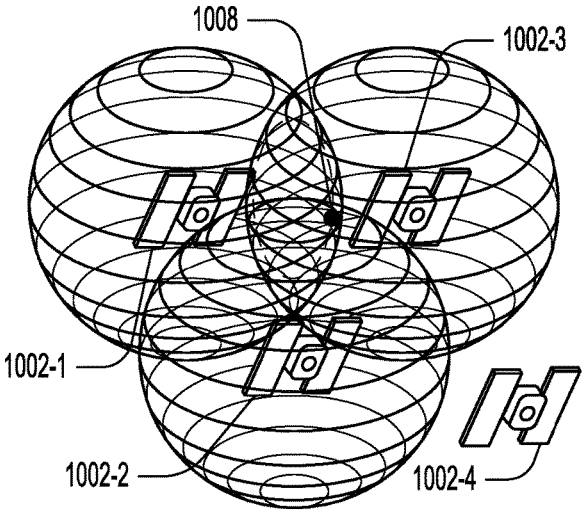

FIG. 10C shows a third scenario in which GNSS receiver 810 receives GNSS signals 804 from a third satellite 1002-3 and generates a distance estimate (e.g., 25,800 km) for the additional satellite. This informs GNSS receiver 810 that it is also located somewhere on the surface of a sphere with a radius of 25,800 km, centered on third satellite 1002-3. This limits the possible locations to two points 1006 where first sphere 1002-1, second sphere 1002-2, and third sphere 1002-3 intersect. FIG. 10D shows a fourth scenario in which GNSS receiver 810 receives GNSS signals 804 from a fourth satellite 1002-4. Fourth satellite 1002-4 can be used to resolve which of points 1006 is a correct point 1008 (by generating a fourth sphere) and/or to synchronize the receiver's clock with the satellites' time.

Figure 11:
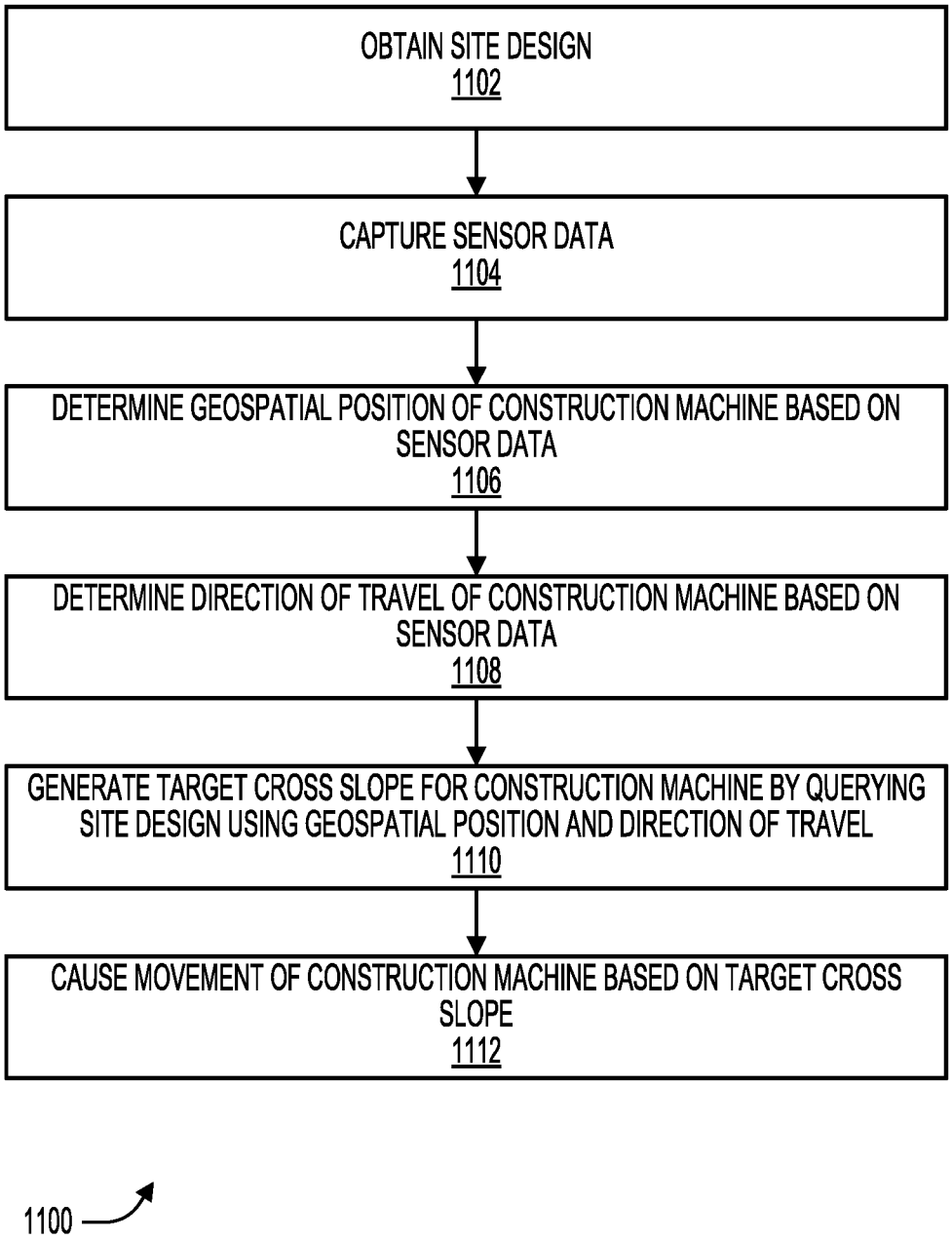
FIG. 11 illustrates a method for controlling a cross slope of a construction machine.

FIG. 11 illustrates a method 1100 for controlling the cross slope of a construction machine, according to some embodiments of the present disclosure. One or more steps of method 1100 may be performed in a different order than that shown in the illustrated embodiment, and one or more steps of method 1100 may be omitted during performance of method 1100. Method 1100 can be implemented as a computer-readable medium or computer program product comprising instructions which, when the program is executed by one or more computers, cause the one or more computers to carry out the steps of method 1100. Such computer program products can be transmitted, over a wired or wireless network, in a data carrier signal carrying the computer program product.

At step 1102, a site design (e.g., site designs 170, 270, 370) that includes a set of target cross slopes for a construction site (e.g., construction site 110) is obtained. Each of the set of target cross slopes may be associated with a 2D location and/or a 2D region within the construction site. The site design may be received via a user input device (e.g., input device 152) and/or an external computing system (e.g., external computing system 162). In some embodiments, the site design may be generated by a control unit (e.g., control unit 160) of the construction machine and/or may be further modified by the control unit. For example, the site design may be modified to include a plurality of slope regions (e.g., slope regions 344, 444), each being associated with one of the set of target cross slopes and a 2D region.

In some embodiments, the site design is first received by the control unit as including a plurality of slope points (e.g., slope points 207, 307), each being associated with one of the set of target cross slopes and a 2D location. The control unit may then form the plurality of slope regions based on the plurality of slope points, each of the plurality of slope regions being associated with one of the set of target cross slopes and the 2D region that encompasses the corresponding slope point's 2D location. The 2D regions of the plurality of slope regions may be formed by determining a crown line (e.g., crown lines 341) along the center of the construction site, determining a maximum distance line from the construction site, and/or by determining bisecting lines that are equidistant from neighboring 2D slope point locations.

At step 1104, sensor data is captured using at least one sensor (e.g., sensors 154) mounted to the construction machine. The at least one sensor may include a position sensor (e.g., position sensor 155). In some embodiments, the position sensor is a GNSS receiver configured to receive at least one wireless signal (e.g., wireless signals 804) from at least one GNSS satellite (e.g., GNSS satellites 102). In some embodiments, the at least one sensor may include an angle sensor (e.g., angle sensor 165) such as an IMU.

At step 1106, a geospatial position (e.g., geospatial position 122) of the construction machine may be determined based on the sensor data captured by the one or more sensors. The geospatial position of the construction machine may correspond to a position of the position sensor (e.g., sensor point 112) or to a position of a blade (e.g., blade point 108) of the construction machine. In some embodiments, a plurality of sensor points (e.g., sensor points 112) corresponding to multiple time-sequenced positions of the position sensor may be determined based on the sensor data captured by the one or more sensors. The plurality of sensor points can be used to project a center line (e.g., center line 115) of the construction machine. A blade point (e.g., blade point 108) corresponding to the position of the blade may be determined by calculating the intersection point between the center line and the blade.

At step 1108, a direction of travel of the construction machine may be determined based on the sensor data captured by the one or more sensors. The direction of travel of the construction machine may be determined based on a comparison between successive geospatial positions. The direction of travel may be a 2D direction expressed as a cardinal direction and/or as degrees (e.g., with 0 degrees corresponding to North). In some embodiments, the direction of travel may be determined based on sensor data captured by the angle sensor, which can provide a yaw angle of the construction machine.

At step 1110, a target cross slope (e.g., target cross slope $S_T$) is generated for the construction machine based on the geospatial position of the construction machine and the direction of travel of the construction machine. In some embodiments, the target cross slope is generated by querying the site design using the geospatial position of the construction machine and the direction of travel of the construction machine. In one example, the site design is saved in the control unit's memory and the geospatial position of the construction machine is searched to determine the target cross slope. Concurrently or subsequently, the target cross slope can be modified based on the direction of travel. For example, the site design may indicate that the target cross slope for a particular geospatial position is +3.0%. Thereafter, it may be determined that the direction of travel is opposite of an assumed direction of travel (e.g., the construction machine is traveling along the left side of the road), and accordingly the target cross slope can be modified from +3.0% to −3.0%.

In another example, the site design is saved in the control unit's memory and the geospatial position of the construction machine is searched to obtain two possible target cross slopes (e.g., +3.0% to −3.0%). Concurrently or subsequently, one of the two possible target cross slopes is selected based on the direction of travel. In another example, the geospatial position of the construction machine is searched within the site design to obtain a target cross slope for an assumed direction of travel (e.g., traveling on right side of road). Thereafter, upon obtaining additional sensor data and determining additional position estimates based on the additional sensor data, the target cross slope can be modified (e.g., by a sign change) if the construction machine is determined to not be traveling in the assumed direction of travel.

At step 1112, the construction machine is caused to move based on the target cross slope. In some embodiments, the target cross slope may be fed into a slope controller (e.g., slope controller 163) that drives the cross slope of the construction machine toward the target cross slope by moving one or more actuators (e.g., actuators 156) of the construction machine.

Figure 12:
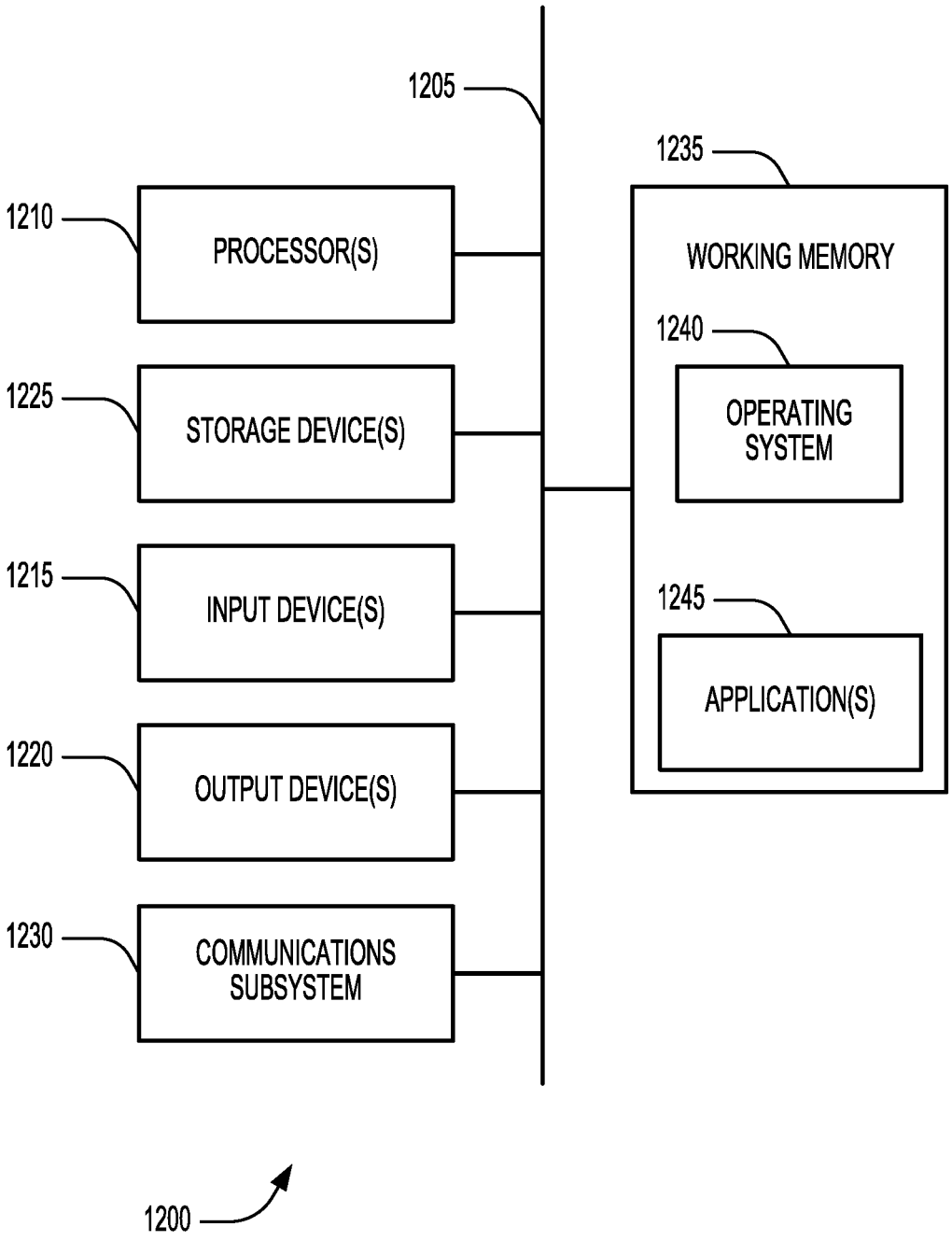
FIG. 12 illustrates a simplified computer system.

FIG. 12 illustrates a simplified computer system 1200, according to some embodiments of the present disclosure. Computer system 1200 as illustrated in FIG. 12 may be incorporated into devices such as control unit 160, external computing system 162, input devices 152, sensors 154, or some other device described herein. FIG. 12 provides a schematic illustration of one embodiment of computer system 1200 that can perform some or all of the steps of the methods provided by various embodiments. It should be noted that FIG. 12 is meant only to provide a generalized illustration of various components, any or all of which may be utilized as appropriate. FIG. 12, therefore, broadly illustrates how individual system elements may be implemented in a relatively separated or more integrated manner.

Computer system 1200 is shown comprising hardware elements that can be electrically coupled via a bus 1205, or may otherwise be in communication, as appropriate. The hardware elements may include one or more processors 1210, including without limitation one or more general-purpose processors and/or one or more special-purpose processors such as digital signal processing chips, graphics acceleration processors, and/or the like; one or more input devices 1215, which can include, without limitation a mouse, a keyboard, a camera, and/or the like; and one or more output devices 1220, which can include, without limitation a display device, a printer, and/or the like.

Computer system 1200 may further include and/or be in communication with one or more non-transitory storage devices 1225, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable, and/or the like. Such storage devices may be configured to implement any appropriate data stores, including without limitation, various file systems, database structures, and/or the like.

Computer system 1200 might also include a communications subsystem 1230, which can include, without limitation a modem, a network card (wireless or wired), an infrared communication device, a wireless communication device, and/or a chipset such as a Bluetooth™ device, an 802.11 device, a WiFi device, a WiMax device, cellular communication facilities, etc., and/or the like. The communications subsystem 1230 may include one or more input and/or output communication interfaces to permit data to be exchanged with a network such as the network described below to name one example, to other computer systems, and/or any other devices described herein. Depending on the desired functionality and/or other implementation concerns, a portable electronic device or similar device may communicate image and/or other information via the communications subsystem 1230. In other embodiments, a portable electronic device, e.g. the first electronic device, may be incorporated into computer system 1200, e.g., an electronic device as an input device 1215. In some embodiments, computer system 1200 will further comprise a working memory 1235, which can include a RAM or ROM device, as described above.

Computer system 1200 also can include software elements, shown as being currently located within the working memory 1235, including an operating system 1240, device drivers, executable libraries, and/or other code, such as one or more application programs 1245, which may comprise computer programs provided by various embodiments, and/or may be designed to implement methods, and/or configure systems, provided by other embodiments, as described herein. Merely by way of example, one or more procedures described with respect to the methods discussed above can be implemented as code and/or instructions executable by a computer and/or a processor within a computer; in an aspect, then, such code and/or instructions can be used to configure and/or adapt a general purpose computer or other device to perform one or more operations in accordance with the described methods.

A set of these instructions and/or code may be stored on a non-transitory computer-readable storage medium, such as the storage device(s) 1225 described above. In some cases, the storage medium might be incorporated within a computer system, such as computer system 1200. In other embodiments, the storage medium might be separate from a computer system e.g., a removable medium, such as a compact disc, and/or provided in an installation package, such that the storage medium can be used to program, configure, and/or adapt a general purpose computer with the instructions/code stored thereon. These instructions might take the form of executable code, which is executable by computer system 1200 and/or might take the form of source and/or installable code, which, upon compilation and/or installation on computer system 1200 e.g., using any of a variety of generally available compilers, installation programs, compression/decompression utilities, etc., then takes the form of executable code.

It will be apparent to those skilled in the art that substantial variations may be made in accordance with specific requirements. For example, customized hardware might also be used, and/or particular elements might be implemented in hardware or software including portable software, such as applets, etc., or both. Further, connection to other computing devices such as network input/output devices may be employed.

As mentioned above, in one aspect, some embodiments may employ a computer system such as computer system 1200 to perform methods in accordance with various embodiments of the technology. According to a set of embodiments, some or all of the procedures of such methods are performed by computer system 1200 in response to processor 1210 executing one or more sequences of one or more instructions, which might be incorporated into the operating system 1240 and/or other code, such as an application program 1245, contained in the working memory 1235. Such instructions may be read into the working memory 1235 from another computer-readable medium, such as one or more of the storage device(s) 1225. Merely by way of example, execution of the sequences of instructions contained in the working memory 1235 might cause the processor(s) 1210 to perform one or more procedures of the methods described herein. Additionally or alternatively, portions of the methods described herein may be executed through specialized hardware.

The terms "machine-readable medium" and "computer-readable medium," as used herein, refer to any medium that participates in providing data that causes a machine to operate in a specific fashion. In an embodiment implemented using computer system 1200, various computer-readable media might be involved in providing instructions/code to processor(s) 1210 for execution and/or might be used to store and/or carry such instructions/code. In many implementations, a computer-readable medium is a physical and/or tangible storage medium. Such a medium may take the form of a non-volatile media or volatile media. Non-volatile media include, for example, optical and/or magnetic disks, such as the storage device(s) 1225. Volatile media include, without limitation, dynamic memory, such as the working memory 1235.

Common forms of physical and/or tangible computer-readable media include, for example, a floppy disk, a flexible disk, hard disk, magnetic tape, or any other magnetic medium, a CD-ROM, any other optical medium, punch-cards, papertape, any other physical medium with patterns of holes, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 1210 for execution. Merely by way of example, the instructions may initially be carried on a magnetic disk and/or optical disc of a remote computer. A remote computer might load the instructions into its dynamic memory and send the instructions as signals over a transmission medium to be received and/or executed by computer system 1200.

The communications subsystem 1230 and/or components thereof generally will receive signals, and the bus 1205 then might carry the signals and/or the data, instructions, etc. carried by the signals to the working memory 1235, from which the processor(s) 1210 retrieves and executes the instructions. The instructions received by the working memory 1235 may optionally be stored on a non-transitory storage device 1225 either before or after execution by the processor(s) 1210.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of exemplary configurations including implementations. However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a schematic flowchart or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the technology. Also, a number of steps may be undertaken before, during, or after the above elements are considered. Accordingly, the above description does not bind the scope of the claims.

As used herein and in the appended claims, the singular forms "a", "an", and "the" include plural references unless the context clearly dictates otherwise. Thus, for example, reference to "a user" includes a plurality of such users, and reference to "the processor" includes reference to one or more processors and equivalents thereof known to those skilled in the art, and so forth.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. A computer-implemented method comprising:

obtaining a site design that includes a set of target cross slopes for a construction site, wherein each of the set of target cross slopes is associated with a two-dimensional (2D) location within the construction site;

capturing sensor data using at least one sensor mounted to a construction machine, wherein the at least one sensor includes a position sensor;

determining a geospatial position of the construction machine based on the sensor data captured by the at least one sensor;

determining a direction of travel of the construction machine based on the sensor data captured by the at least one sensor;

generating a target cross slope for the construction machine by querying the site design using the geospatial position of the construction machine and the direction of travel of the construction machine, wherein the target cross slope is a first target cross slope if the direction of travel is a first direction of travel and the target cross slope is a second target cross slope if the direction of travel is a second direction of travel; and causing movement of the construction machine based on the target cross slope.

2. The method of claim 1, wherein the geospatial position of the construction machine corresponds to a position of the position sensor.

3. The method of claim 1, wherein the geospatial position of the construction machine corresponds to a position of a blade of the construction machine.

4. The method of claim 3, further comprising:

determining a plurality of sensor points of the construction machine based on the sensor data captured by the at least one sensor, wherein the plurality of sensor points correspond to positions of the position sensor over a duration of time;

projecting a center line of the construction machine based on the plurality of sensor points; and determining a blade point of the construction machine based on the center line, wherein the blade point corresponds to the position of the blade.

5. The method of claim 1, wherein capturing the sensor data using the at least one sensor mounted to the construction machine includes:

receiving, using a global navigation satellite systems (GNSS) receiver mounted to the construction machine, at least one wireless signal from at least one GNSS satellite.

6. The method of claim 5, wherein the geospatial position of the construction machine is determined based on the at least one wireless signal.

7. The method of claim 5, wherein the direction of travel of the construction machine is determined based on the at least one wireless signal.

8. A non-transitory computer-readable medium storing instructions therein that, when executed by one or more processors, cause the one or more processors to perform operations comprising:

obtaining a site design that includes a set of target cross slopes for a construction site, wherein each of the set of target cross slopes is associated with a two-dimensional (2D) location within the construction site;

capturing sensor data using at least one sensor mounted to a construction machine, wherein the at least one sensor includes a position sensor;

determining a geospatial position of the construction machine based on the sensor data captured by the at least one sensor;

determining a direction of travel of the construction machine based on the sensor data captured by the at least one sensor;

generating a target cross slope for the construction machine by querying the site design using the geospatial position of the construction machine and the direction of travel of the construction machine, wherein the target cross slope is a first target cross slope if the direction of travel is a first direction of travel and the target cross slope is a second target cross slope if the direction of travel is a second direction of travel; and causing movement of the construction machine based on the target cross slope.

9. The non-transitory computer-readable medium of claim 8, wherein the geospatial position of the construction machine corresponds to a position of the position sensor.

10. The non-transitory computer-readable medium of claim 8, wherein the geospatial position of the construction machine corresponds to a position of a blade of the construction machine.

11. The non-transitory computer-readable medium of claim 10, further comprising:

determining a plurality of sensor points of the construction machine based on the sensor data captured by the at least one sensor, wherein the plurality of sensor points correspond to positions of the position sensor over a duration of time;

projecting a center line of the construction machine based on the plurality of sensor points; and determining a blade point of the construction machine based on the center line, wherein the blade point corresponds to the position of the blade.

12. The non-transitory computer-readable medium of claim 8, wherein capturing the sensor data using the at least one sensor mounted to the construction machine includes:

receiving, using a global navigation satellite systems (GNSS) receiver mounted to the construction machine, at least one wireless signal from at least one GNSS satellite.

13. The non-transitory computer-readable medium of claim 12, wherein the geospatial position of the construction machine is determined based on the at least one wireless signal.

14. The non-transitory computer-readable medium of claim 12, wherein the direction of travel of the construction machine is determined based on the at least one wireless signal.

15. A machine control system comprising:

a position sensor mounted to a construction machine and configured to detect a geospatial position of the construction machine; and a control unit communicatively coupled to the position sensor and configured to perform operations comprising:

obtaining a site design that includes a set of target cross slopes for a construction site, wherein each of the set of target cross slopes is associated with a two-dimensional (2D) location within the construction site;

capturing sensor data using at least one sensor mounted to the construction machine, wherein the at least one sensor includes the position sensor;

determining the geospatial position of the construction machine based on the sensor data captured by the at least one sensor;

determining a direction of travel of the construction machine based on the sensor data captured by the at least one sensor;

generating a target cross slope for the construction machine by querying the site design using the geospatial position of the construction machine and the direction of travel of the construction machine, wherein the target cross slope is a first target cross slope if the direction of travel is a first direction of travel and the target cross slope is a second target cross slope if the direction of travel is a second direction of travel; and causing movement of the construction machine based on the target cross slope.

16. The machine control system of claim 15, wherein the geospatial position of the construction machine corresponds to a position of the position sensor.

17. The machine control system of claim 15, wherein the geospatial position of the construction machine corresponds to a position of a blade of the construction machine.

18. The machine control system of claim 17, further comprising:

determining a plurality of sensor points of the construction machine based on the sensor data captured by the at least one sensor, wherein the plurality of sensor points correspond to positions of the position sensor over a duration of time;

projecting a center line of the construction machine based on the plurality of sensor points; and determining a blade point of the construction machine based on the center line, wherein the blade point corresponds to the position of the blade.

19. The machine control system of claim 15, wherein capturing the sensor data using the at least one sensor mounted to the construction machine includes:

receiving, using a global navigation satellite systems (GNSS) receiver mounted to the construction machine, at least one wireless signal from at least one GNSS satellite.

20. The machine control system of claim 19, wherein the geospatial position of the construction machine is determined based on the at least one wireless signal.

* * * * *